US007549874B2

(12) United States Patent
Chang et al.

(10) Patent No.: US 7,549,874 B2
(45) Date of Patent: Jun. 23, 2009

(54) SOCKET MOUNTED TO PRINTED CIRCUIT BOARD

(75) Inventors: Chun-Yi Chang, Tu-Cheng (TW); Nan-Hong (Nick) Lin, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/895,775

(22) Filed: Aug. 27, 2007

(65) Prior Publication Data

US 2008/0050948 A1 Feb. 28, 2008

(51) Int. Cl.
*H01R 12/00* (2006.01)

(52) U.S. Cl. ..... 439/83; 439/876

(58) Field of Classification Search ..... 439/83, 439/876, 933

See application file for complete search history.

(56) References Cited

U.S. PATENT DOCUMENTS 6,220,884 B1 * 4/2001 Lin ..... 439/342
6,501,665 B1 * 12/2002 Ted ..... 361/808
6,913,468 B2 * 7/2005 Dozier et al. ..... 439/66
7,128,622 B2 * 10/2006 Tsai ..... 439/874
7,147,489 B1 * 12/2006 Lin ..... 439/83
2004/0192087 A1 * 9/2004 Ju ..... 439/83
2006/0128184 A1 * 6/2006 Forman ..... 439/83

* cited by examiner

*Primary Examiner*—Gary F. Paumen
(74) *Attorney, Agent, or Firm*—Wei Te Chung

(57) ABSTRACT

A socket, adapt for electrically connecting a semiconductor package to a print circuit board, comprises an insulating housing, a plurality of contacts received in the insulating housing and a plurality of solder balls disposed on bottom ends of the contacts. The socket is mounted on the print circuit board by soldering the solder balls to the print circuit board, after that, an accessional member, which is made of epoxy resin, is displaced between the insulating housing and the print circuit board by insert-molding to surround the solder balls.

13 Claims, 2 Drawing Sheets

SOCKET MOUNTED TO PRINTED CIRCUIT BOARD

BACKGROUND OF THE INVENTION

1. Field of the Invention

The present invention relates to a socket, especially to a socket for electrically connecting a semiconductor package to a print circuit board.

2. Description of the Related Art

Referring to FIG. 1, a conventional electrical connector 1, for electrically connecting a semiconductor package 2 to a print circuit board 3, comprises an insulating body 10 defining a plurality of receiving slots 100, a plurality of contacts 11 received in the receiving slots 100 and a plurality of solder balls 12 disposed on bottom ends of the contacts 11. The contact 11 has a main body 111, a contacting portion 112 for electrically contacting with the semiconductor package 2 and a solder portion 113 extending downwardly from the main body 111 and connecting with the solder ball 12. A soldering point 120 is formed at a linking portion of the solder ball 12 and the print circuit board 3. The solder balls 12 are soldered to the print circuit board 3 to make the socket 1 electrically connect with the print circuit board 3, firstly, then, the semiconductor package 2 is put in the insulating body 10 to contact with the contacting portions 112 of the contacts 11, so the semiconductor package 2 is electrically connect with the print circuit board 3.

However, when mounting the socket 1 to the print circuit board 3, the socket 1 may mismatch with the print circuit board 3, during a process of rising and falling temperature of the print circuit board 3, the socket 1 may occur a stress acted on the soldering point 120, the stress may crack the soldering point 120 and influence a soldering quality of the socket 1 with the print circuit board 3, even make the socket 1 unusable.

Hence, an improved socket is required to overcome the disadvantages of the prior art.

SUMMARY OF THE INVENTION

An object of the invention is to provide a socket which can protect soldering points of solder balls.

To achieve the above-mentioned object, a socket, for being mounted to a print circuit board, comprises an insulating housing receiving a plurality of contacts and defining a soldering surface adapted for facing the print circuit board; a plurality solder balls disposed on the contacts and adapted to contact with the print circuit board; and an accessional member surrounding the solder balls.

Other features and advantages of the present invention will become more apparent to those skilled in the art upon examination of the following drawings and detailed description of preferred embodiments, in which:

DETAILED DESCRIPTION OF PREFERRED EMBODIMENT

Reference will now be made in detail to the preferred embodiment of the present invention.

Figure 1:
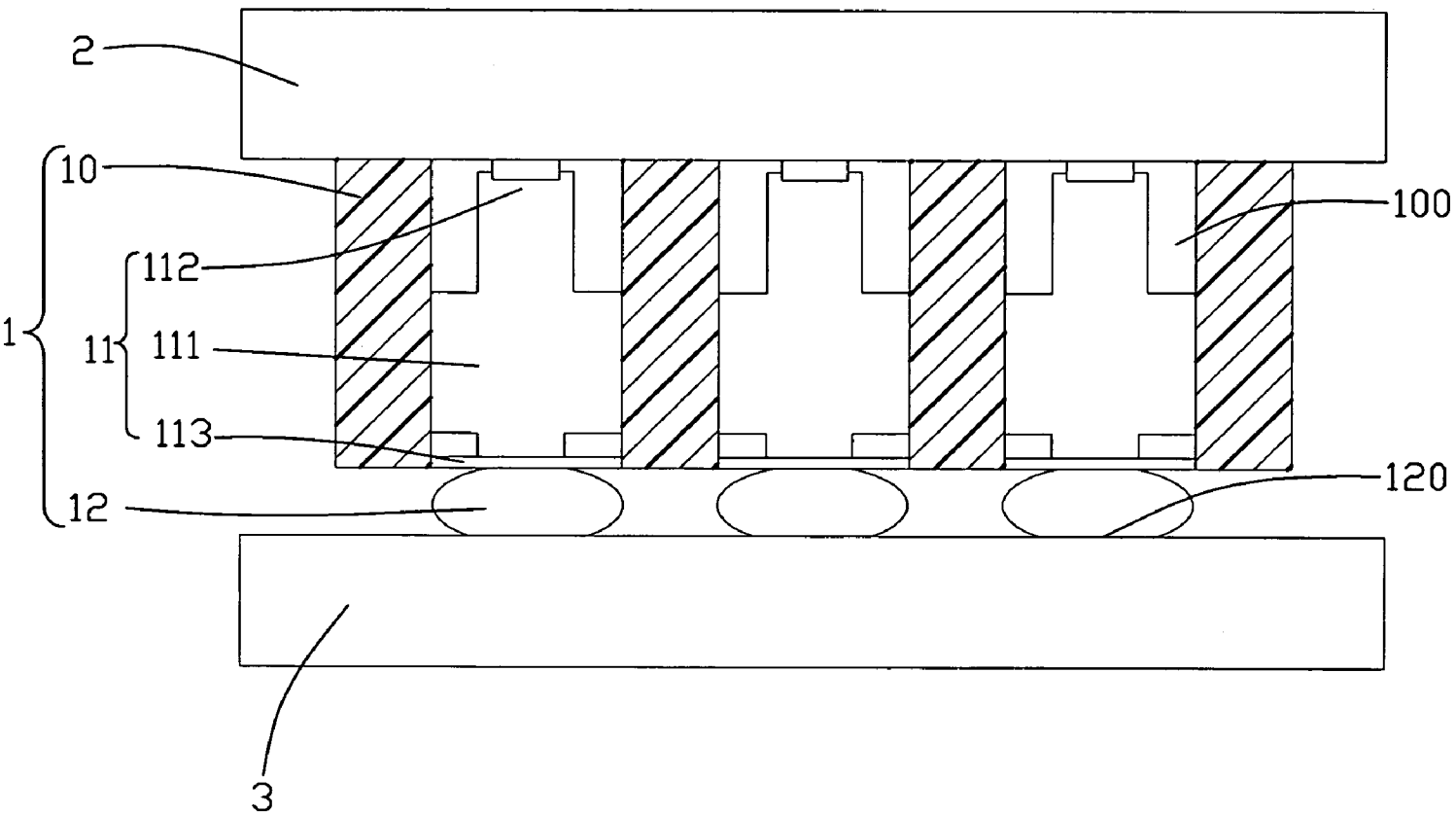
FIG. 1 (RELATED ART)
FIG. 1 is a sketch of a conventional socket connecting a semiconductor package and a print circuit board.
Figure 2:
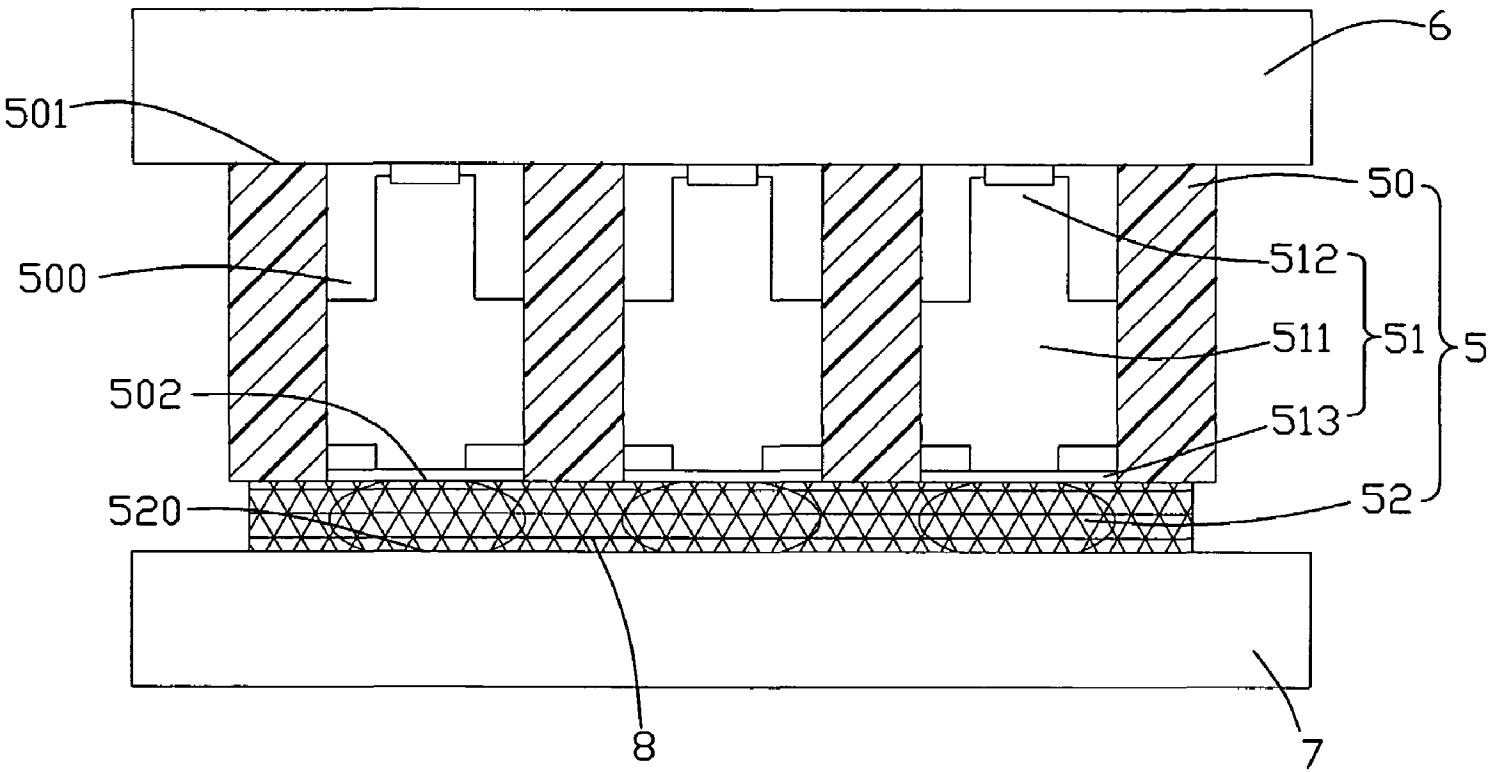
FIG. 2 is a sketch of a socket of the present invention connecting a semiconductor package and a print circuit board.

Referring to FIG. 2, a socket 5, which is adapted for electrically connecting a semiconductor package 6 to a print circuit board 7, comprises an insulating housing 50, a plurality of contacts 51 accommodated in the insulating housing 50 and a plurality of solder balls 52 disposed on bottom ends of the contacts 51.

The insulating housing 50 is substantially in a quadrate shape, and has a linking surface 501 for connecting with the semiconductor package 6 and a soldering surface 502 facing a top surface of the print circuit board 7. A plurality of receiving holes 500 extend through the linking surface 501 and the soldering surface 502 for receiving the contacts 51. Each contact 51 has a main body 511 displaced in the receiving hole 500, a contacting portion 512 upwardly extending from the main body 511 to electrically contact with the semiconductor package 6 and a soldering portion 513 downwardly extending from the main body 511.

The solder ball 52 is connected with the soldering portion 513 of the contact 51 and located between the soldering surface 502 of the insulating housing 50 and the print circuit board 7 to electrically connect the contacts 51 to the print circuit board 7. The solder ball 52 has a soldering point 520 at a joint portion of the solder ball 52 and the print circuit board 7.

After the socket 5 is soldered to the print circuit board 7 by soldering the solder ball 52 to the print circuit board 7, an accessional member 8, which is made of insulating material, such as epoxy resin, is displaced between the soldering surface 502 of the insulting housing 50 and the top surface of the print circuit board 7 by insert-molding. The accessional member 8 surrounds the soldering points 520 of the solder balls 52 to enhance an intensity of each soldering point 520, so that the soldering portion 520 is prevented from cracking and the socket 5 reliably connects the semiconductor package 6 and the print circuit board 7.

It is should be noted that the contacts 51 can electrically connect with the print circuit board 7 not only by surface-soldering technology, which is adapted in present embodiment, but also by through-hole technology, that means the contacts 51 can have legs inserting into and electrically connecting with the print circuit board 7, the accessional member 8 surrounds the legs after the socket 5 soldered to the print circuit board 7 by insert-molding.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. A socket, for being mounted to a printed circuit board, comprising:

an insulating housing receiving a plurality of contacts and defining a soldering surface adapted for facing the printed circuit board;

a plurality solder balls disposed on the contacts and adapted for contacting with the printed circuit board; and an accessional member surrounding the solder balls and disposed between the soldering surface of the insulating housing and the printed circuit board, after the solder balls are soldered to the printed circuit board.

2. The socket as described in claim 1, wherein the solder ball has a soldering point at a linking portion of the solder ball and the printed circuit board, the accessional member surrounds the soldering points.

3. The socket as described in claim 1, wherein the accessional member is made of epoxy resin and displaced between the insulating housing and the printed circuit board by insert-molding.

4. A socket, adapted for connecting a semiconductor package to a printed circuit board, comprising:

an insulating housing defining a surface facing the printed circuit board;

a plurality contacts received in the insulating housing; and an accessional member disposed between the surface of the insulating housing and the printed circuit board by insert-molding after the socket is soldered to the printed circuit board.

5. The socket as described in claim 4, comprising a plurality of solder balls disposed on bottom ends of the contacts, the accessional member surrounds the solder balls.

6. The socket as described in claim 4, wherein the contacts have legs, the accessional member surrounds the legs.

7. The socket as described in claim 5, wherein the accessional member is made of epoxy resin.

8. The socket as described in claim 6, wherein the accessional member is made of epoxy resin.

9. The socket as described in claim 4, wherein the accessional member engages at least one of said printed circuit board and said surface.

10. The socket as described in claim 4, wherein the accessional member engages both said printed circuit board and said surface.

11. A socket assembly comprising:

a printed circuit board;

an insulating housing positioned above the printed circuit board and defining a surface facing the printed circuit board;

a plurality contacts received in the insulating housing, each of the contacts equipped with a solder ball at a bottom; and an accessional member surrounding and intimately positioning the solder balls; wherein said accessional member engages said surface and said printed circuit board.

12. The socket assembly as described in claim 11, wherein said accessional member is placed between the surface of the insulating housing and the printed circuit board after the socket is solder to the printed circuit board.

13. The socket assembly as described in claim 11, wherein said accessional member essentially wholly fills a space right between the said surface and said printed circuit board and among the solder balls.

* * * * *